US006269598B1

(12) United States Patent
Wintermantel

(10) Patent No.: US 6,269,598 B1
(45) Date of Patent: Aug. 7, 2001

(54) FLOW CHANNEL STRUCTURES, BUILDINGS INCORPORATING FLOW CHANNEL STRUCTURES, AND METHODS OF FORMING FLOW CHANNEL STRUCTURES

(75) Inventor: Erich Wintermantel, Bonn (DE)

(73) Assignee: Wintermantel, Brich (DE)

( * ) Notice: Subject to any disclaimer, the term of this patent is extended or adjusted under 35 U.S.C. 154(b) by 0 days.

(21) Appl. No.: 09/358,858

(22) Filed: Jul. 22, 1999

(30) Foreign Application Priority Data

Jan. 8, 1999 (DE) ..... 199 00 518

(51) Int. Cl.[7] ..... E04C 2/52

(52) U.S. Cl. ..... 52/220.1; 52/220.3; 52/198; 52/738.1; 52/2.23

(58) Field of Search ..... 52/220.1, 220.2, 52/220.3, 220.4, 220.5, 220.8, 2.23, 198, 738.1

(56) References Cited

U.S. PATENT DOCUMENTS

| | | | | |
|---|---|---|---|---|
| 1,683,441 | * | 9/1928 | Bone | 52/605 |
| 3,299,795 | | 1/1967 | Teixeira . | |
| 4,132,577 | | 1/1979 | Wintermantel . | |
| 4,147,300 | | 4/1979 | Milburn, Jr. . | |
| 4,384,609 | | 5/1983 | Neuzil . | |
| 4,412,880 | | 11/1983 | Wintermantel . | |
| 4,579,658 | * | 4/1986 | Moller | 210/483 |
| 4,799,822 | | 1/1989 | Wintermantel et al. . | |
| 5,229,055 | | 7/1993 | Wintermantel et al. . | |
| 5,561,958 | * | 10/1996 | Clement et al. | 52/407.1 |
| 5,761,864 | | 6/1998 | Nonoshita . | |

FOREIGN PATENT DOCUMENTS 1 454 657 3/1970 (DE) .

* cited by examiner

*Primary Examiner*—Christopher T. Kent
*Assistant Examiner*—Jennifer I. Thissell
(74) *Attorney, Agent, or Firm*—Larson & Taylor, PLC

(57) ABSTRACT

For the exchange of thermal energy between flowable media and the surroundings, said media are directionally conveyed in sectional structures, etc. The invention relates to sectional elements and sectional modules which are used in combination with paste-like, solidifiable coating materials. The coating material passes through the perforated, flow guiding walls of the elements or modules and results, amongst other effects, in an increase of the surface area and in an intensification of the interaction between the flowing material and the surroundings. In a use according to the invention, the external walls, etc., of buildings are provided with a surface composite comprising sectional elements and modules according to the invention in combination with coating materials, for the purpose of effecting economical air-conditioning of the building from the bottom of the basement to the roof.

14 Claims, 10 Drawing Sheets x
y
11.10
11.3
11.1
F
A
F
x
y
D
H H H A F A A F A H H H H H
z
11.4
F
F
z

FLOW CHANNEL STRUCTURES, BUILDINGS INCORPORATING FLOW CHANNEL STRUCTURES, AND METHODS OF FORMING FLOW CHANNEL STRUCTURES

BACKGROUND OF THE INVENTION

This invention relates to the construction and geometric form of sectional elements and sectional modules, to the combination of these elements and modules with coating materials and functional layers and/or functional elements, and to the uses of elements, modules and combinations of this type.

The sectional elements, sectional modules and combinations of these elements and modules with coating materials and functional layers and/or functional elements according to the invention are used in particular for the directional conveying of flowable media with the occurrence of an exchange of energy and/or matter from a flowing material to a flowing material and/or between a flowing material and a surrounding material and optionally also to media adjacent thereto. In uses of this type, sectional elements and sectional modules according to the invention are generally employed in a composite comprising a plurality of identical sectional elements or sectional modules or in mixed combinations of elements and/or modules of this type. In the use according to the invention of corresponding sectional elements and sectional modules, the external walls, etc., of buildings, in the region above the top edge of the ground between the supporting and weather-protection shells and in the region below the top edge of the ground between the supporting shell and the adjoining ground, can be provided with a harmonisation flow which communicates with the external air in such a way that air-conditioning of the building is effected which is both comfortable and user-friendly and which is inexpensive and is matched to daily and yearly atmospheric conditions. Moreover, this harmonisation flow results in the equilibration of the building structure of the building as a result of the homogenisation of the temperature of the structure and of the regulation of the moisture balance.

It is known that flowable media can be conveyed directionally, and free from leaks to a greater or lesser extent, by means of sectional elements and modules which are formed in the shape of channels. It is also known that an exchange of energy, particularly an exchange of thermal energy from a flowing material to a flowing material and/or between a flowing material and a surrounding material and optionally also to media adjacent thereto, occurs on the flow of media through corresponding elements or modules (the principle of the heat exchanger). Furthermore, it is known that elements or modules of this type can be provided, as a whole or in parts thereof, with functional layers, e.g. with thermally insulating layers, which restrict the exchange of energy described above and which optionally even substantially suppress it. In addition, it is known that corresponding elements and modules can be provided with coatings, e.g. for the purpose of protecting them from corrosion and/or wear. Wear-protection layers, particularly when they are designed to be replaceable, constitute one example of the fact that a desired or undesired exchange of matter can occur between a flowing material and a surrounding material, in addition to a desired or undesired exchange of energy. As is known, an exchange of matter between a flowing material and a surrounding material can also occur on the path of diffusion via the delimiting walls of the flow channels. It is also known that the known elements and modules described above can be provided with ingresses and penetrations, e.g. for the purpose of feeding and discharging flowing material, for the purposes of storage, removal, measurement or regulation or for another type of effect on a flowing material. The use over large surface areas of sectional elements comprising a bonded-in functional or insulating layer and integrated flow guidance channels for the purpose of providing background ventilation of facades is known in building construction. Given that the atmospheric conditions are appropriate, this results in an exchange of both thermal energy and of matter in the form of water vapour between the surrounding material and the background ventilation flow which is supplied from the surrounding air.

OBJECTS AND SUMMARY OF THE INVENTION

In particular, the sectional elements and sectional modules according to the invention differ from known sectional elements and modules by the form of construction of the flow guiding and delimiting walls of the flow channels. Whereas known elements and sections have channel walls of single- or multi-layer construction, so that each wall layer has a substantially uniform material structure, the flow guiding walls of the sectional elements and sectional modules according to the invention are of open-worked form, over their entire area or over parts thereof, e.g. are of mesh-like or perforated construction. If the sectional elements and sectional modules according to the invention are adapted to the conditions of use by combining them with a paste-like, solidifiable coating material, the coating material expands into the space opposite the coating side with the formation of nodules, pegs, projections or the like. A more intensive or less intensive exchange of energy and/or matter or another type of interaction between a flowing material and a surrounding material, and optionally an interaction with media, materials and/or building structures with are adjacent thereto, can occur via the increase in the surface area of the walls which is achieved in this manner. Thus, for example, a change in direction of the flow, e.g. a swirling flow, can be produced by the geometry and/or arrangement of nodules of solidified coating material which protrude into the flow space.

As determined by their use, sectional elements and sectional modules according to the invention can be provided, for example, with functional layers such as heat- and sound-insulating layers, radiation absorption layers and/or radiation-reflecting layers. When sectional elements and sectional module of this type are coated according to the invention with a paste-like, solidifiable substance, a composite can be created between this substance, the adjoining functional layers and the sectional elements and modules. At the same time, the functional layers can be imparted with a form of construction such that they not only intensify the desired interaction between the flowing material and the surrounding material on account of their material properties, but also intensify said interaction on account of their geometric form, e.g. due to their comparatively large surface area.

As determined by the conditions of use, coating materials can also be used for the coating according to the invention of sectional elements and sectional modules according to the invention which after penetrating the walls of the section or module and after entering the flow space do not solidify causing an increase in surface area but retain their paste-like consistency or a consistency which is susceptible to attrition, so that they are broken down or removed by the flowing material and a desired exchange of matter is effected in this manner from the coating material to the flowing material. A corresponding feeding process can thereby proceed as the coating material is broken down.

After they have been arranged in layers or bundles, sectional elements and sectional modules according to the invention of the type described above can in turn form sectional elements or sectional modules according to the invention with further elements/modules of an identical or different constructional design. In elements and modules of this type, the paste-like coating material, which is optionally solidifiable to a greater or lesser extent, can at the same time penetrate the walls of adjacent sectional elements with an increase in the surface area thereof and/or with the formation of a composite. As determined by the particular use, functional components or functional layers such as heating mats can at the same time be embedded in the coating material.

In all the forms of construction of sectional elements and sectional modules according to the invention which have been described above, the constructional design of the flow guiding and delimiting walls and optionally the constructional design of the functional and facing components in the flow channels can be effected, amongst other considerations, by taking into account overflow and/or circulating flow zones so that within the sectional elements and/or in arrangements comprising a plurality of identical or different elements and/or modules, flows in the same direction or in different directions occur in flow channels with adjacent sides and/or at adjacent heights, or with channels being missed. Flow guidance can also be effected according to the invention so that the flowing material is subjected, as a whole or in part, to changes of direction, or is bundled and/or fanned out. In addition to these features, corresponding sectional elements and sectional modules according to the invention can also be provided with ingresses and/or penetrations which penetrate the flow guiding walls of the elements/modules on one or on a plurality of sides, or can be provided with openings, e.g. for feeding, discharging, measurement or regulation purposes.

In uses according to the invention, a plurality of identical or different sectional elements and/or sectional modules according to the invention can also be combined in a vertical, horizontal, inclined or singly- or multiply-curved surface arrangement. The characterising features, which were described above, of the sections and/or modules which are used here then cooperatively determine the interaction between the flowing material and the surrounding material, and optionally determine the interaction with media, materials and/or building structures which are adjacent thereto.

In a use such as this according to the invention, the external walls of buildings are provided according to the invention, in the region above the top edge of the ground between the supporting and weather-protection shells and in the region below the top edge of the ground between the supporting shell and the adjoining ground, with sectional elements and sectional modules according to the invention which are treated with a paste-like, solidifiable coating material. A harmonisation flow, which has an effect on the flow of thermal energy from or to the adjacent building premises, is produced in the arrangement of sectional elements and sectional modules by convection, using external air as the primary flowing material and optionally with the use of auxiliary means for promoting or reducing flow. In a further embodiment of the invention, air-conditioning of the building, which is both comfortable and user-friendly and which is inexpensive and is matched to daily and yearly atmospheric conditions, is effected under some circumstances in this manner, with equilibration of the building structure of the building as a result of the homogenisation of the temperature of the structure and of the regulation of the moisture balance. This air-conditioning is effected by a direct communication of flow between the harmonisation flow and the air in the interior of the building and/or by a flow of external air into the interior of the building or conversely by a flow of air from the building to the outside, which flow of air crosses the harmonisation flow in a guided manner with the exchange of thermal energy.

The flow channels which are formed by the flow guiding and delimiting walls in sectional elements and sectional modules according to the invention can be of round, oval, rectangular, polygonal or other types of geometric shape. Adjacent flow channels ca be separated by one partition wall only or by a plurality of partition walls, which can be joined by webs for example. The flow conveying channels can be aligned rectilinearly or can have an alignment which is singly- or multiply-curved, and the flow guiding walls may also comprise curves which are superimposed on the course of the channel.

Sectional elements and sectional modules according to the invention may consist of metallic or mineral materials, of natural animal or vegetable materials, of synthetic materials, or of a suitable composite comprising these materials. In combinations according to the invention of sectional elements/modules according to the invention with coating materials, the alternative choices of materials which are applicable to the coating materials are the same as those listed above for the elements/modules, wherein in a combination, the material of the sections/modules on the one hand and that of the layering material on the other hand can be different but must be compatible with each other.

The aforementioned alternative materials for the sectional elements/modules according to the invention are also applicable to the functional layers and functional components of correspondingly equipped elements/modules and to combinations of the same with coating materials. Here also, there must be compatibility of materials between the functional layers which are used, between the functional layers and the respective element/module, and between the functional layers and the coating material.

Openings, perforations or the like in the flow guiding walls of sectional elements and modules according to the invention can be incorporated in the course of producing the preliminary materials for the elements/modules, during the production of the latter or subsequently by known perforation processes such as cutting, punching or drilling for example. In sectional elements/modules according to the invention which consist, for example, of composite materials comprising woven textiles or knitted fabrics or lay-ups as a reinforcing agent, the latter component can also be fabricated so that it has an open-mesh structure from the outset and can thus be employed to provide the perforation of the walls which is desired according to the invention. The sectional elements/modules or flow channel structures may be formed of glass fibre reinforced composite, for example a grid-like woven glass fibre fabric together with a synthetic resin matrix defining the basic wall structure of the flow channels or conduits and a paste-like hardenable or other extrudable material extruded through holes in the basic wall structure to form a layer on and projections from the basic wall structure. Typically the holes in such glass fibre reinforced composite are formed between regularly spaced warp and weft threads or tapes of the fabric.

Similarly holes can be formed between spaced interwoven metal wires defining the basic wall structure of the flow channel, the paste-like layer being e.g. plaster or mortar. Such structures are typically used in building applications.

The paste-like layer may even be of materials such as foam or snow. In this case the projections may be melted and the melted material carried away by the flow medium or fluid flowing through the flow channels. An erosion or consumption process such as this can be controlled e.g. by controlling the temperature of the paste-like mass and/or the temperature of the flow medium.

BRIEF DESCRIPTION OF THE DRAWINGS

FIGS. 1 to 4 are perspective illustrations showing cross-sections of sectional elements according to the invention in combination with coating materials. FIGS. 6 and 7 are also perspective illustrations of sectional elements according to the invention, which clearly show the flow relationships.

FIGS. 5, 8, 9 and 11 are plan views which clearly illustrate the flow relationships in sectional elements according to the invention or in arrangements of sectional elements and sectional modules.

FIG. 10 is a vertical section showing a use according to the invention of correspondingly treated elements and modules in association with an external wall of a building.

DESCRIPTION OF THE PREFERRED EMBODIMENTS

Figure 1:
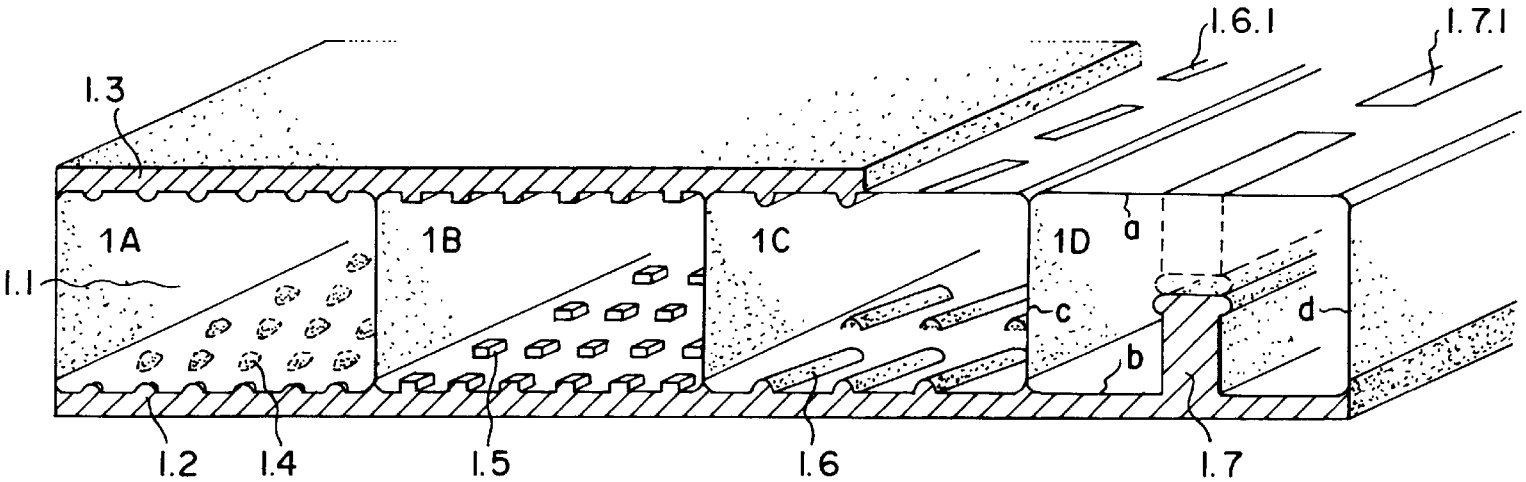
FIGS. 1 to 11 show examples of different combinations according to the invention of sectional elements according to the invention which comprise coating materials, and illustrate corresponding uses according to the invention. In the illustrations of uses, examples of sectional modules according to the invention are illustrated as portions thereof. The examples of sectional elements/modules which are shown in FIGS. 1 to 11 all comprise flow channels of rectangular cross-section, in order better to emphasise their characterising features. The flow guiding and delimiting walls in each case are illustrated in the form of single lines only. This type of illustration also clearly shows that in sectional elements and modules according to the invention which are used in lightweight building construction, e.g. those comprising a fibre composite material based on woven textiles, knitted fabrics or lay-ups, the element walls can be comparatively thin in relation to the combination thereof with the coating material.

FIG. 1 shows a sectional element 1.1 according to the invention, which on one side has the coating material 1.2 and which on the other side has a coating material 1.3 which is made of the same material or of a different material to that of 1.2. The flow channels are denoted by 1A, 1B, 1C and 1D. Each flow channel is delimited by flow guiding walls a, b, c and d. The respective coating material finds its way into the flow channel 1A in the form of nodules 1.4 and increases the surface area of the flow channel. The penetrations in flow channel 1B are in the form of cuboids 1.5, and the penetrations in 1C and 1D are in the form of ribs 1.6 or 1.7 of greater or lesser size. The openings in the delimiting walls at 1.6.1 and 1.7.1 predetermine the cross-section at the base of the respective penetration of material. The coating material can also penetrate different flow conveying channels of a sectional element in different forms, as is shown in this Figure primarily for explanatory reasons. As a rule, however, the wall perforation, and thus the penetration of material also, is uniform for all flow channels within one and the same sectional element. This also applies to the embodiments shown in the subsequent Figures.

Figure 2:
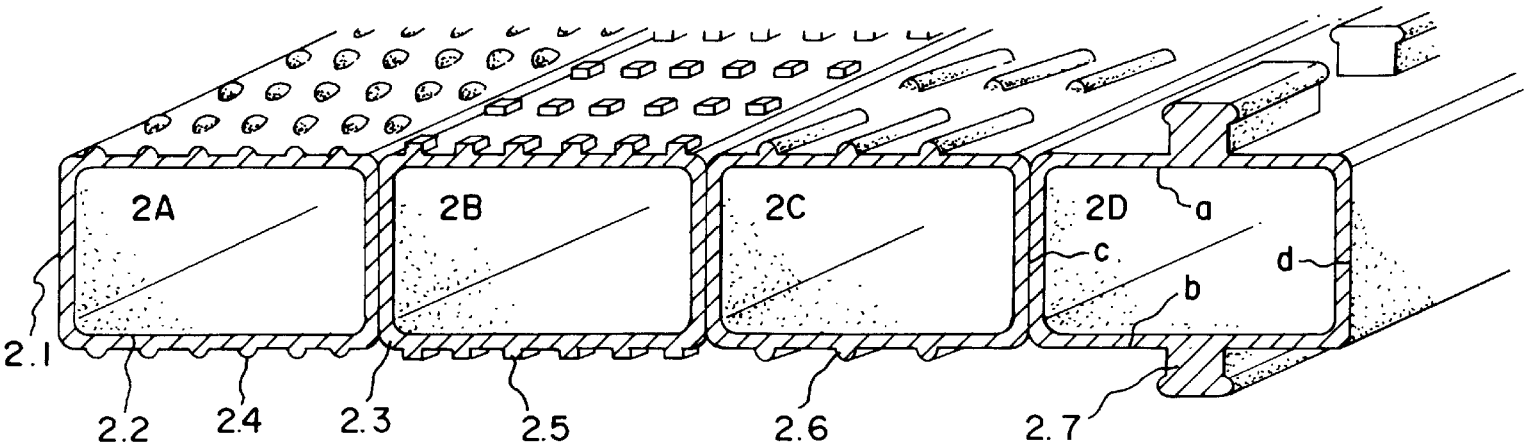

FIG. 2 shows a sectional element 2.1 according to the invention which corresponds to sectional element 1.1 in FIG. 1. In this example of an embodiment, however, the coating material 2.2 in channel 2A, the coating material 2.3 in channel 2B, and the coating material in channels 2C and 2D also, have been applied to the inside of the flow guiding walls a, b, c and d and accordingly emerge from the flow channels in the form of nodules 2.4, cuboids 2.5 and ribs 2.6 or 2.7.

Figure 3:
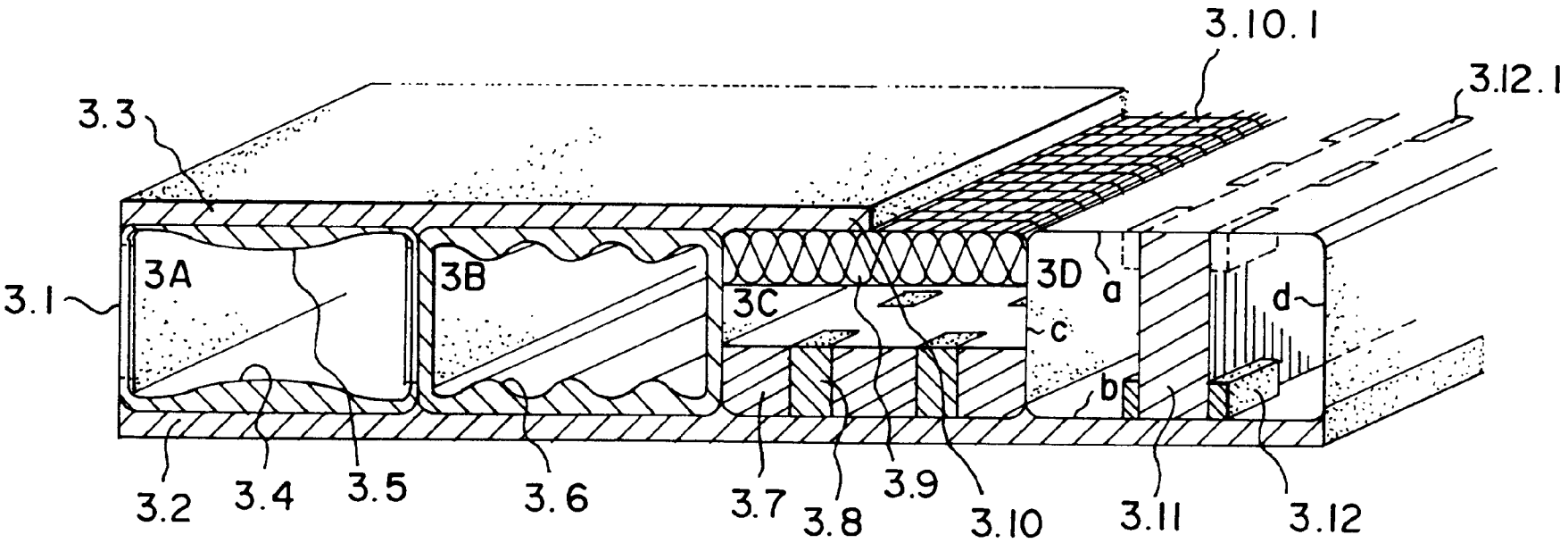

FIG. 3 shows a sectional element 3.1 according to the invention which has flow channels 3A, 3B, 3C and 3D, and which is provided as in FIG. 1 with coating materials 3.2 and 3.3 which enter the flow channels via the perforations in the flow guiding walls a and b. Flow channel 3A is equipped with U-shaped functional layers 3.4 and 3.5 in such a way that on the penetration of the coating material these functional layers expose deposition spaces for the coating materials 3.2 or 3.3 by sliding telescopically within one another. Flow conveying channel 3B is lined with a complete, corrugated functional layer 3.6, the effect of which is thus to increase the surface area. Flow conveying channel 3C is provided on one side with a functional layer 3.7 which comprises openings into which the coating material 3.2 expands, forming a composite with the material 3.8. On its opposite side, this flow channel has a second functional layer 3.9, the porous structure of which is entered by a proportion 3.10 of the coating material 3.3 through the mesh apertures 3.10.1 in the delimiting wall, forming a composite. Flow channel 3D comprises the functional layer 3.11 in the form of a separating web, which is positioned and fixed by the ribs of material 3.12. The basal cross-section of these ribs of material is predetermined by the cross-section of the penetration openings 3.12.1 in the flow guiding/delimiting walls a and b.

Figure 4:
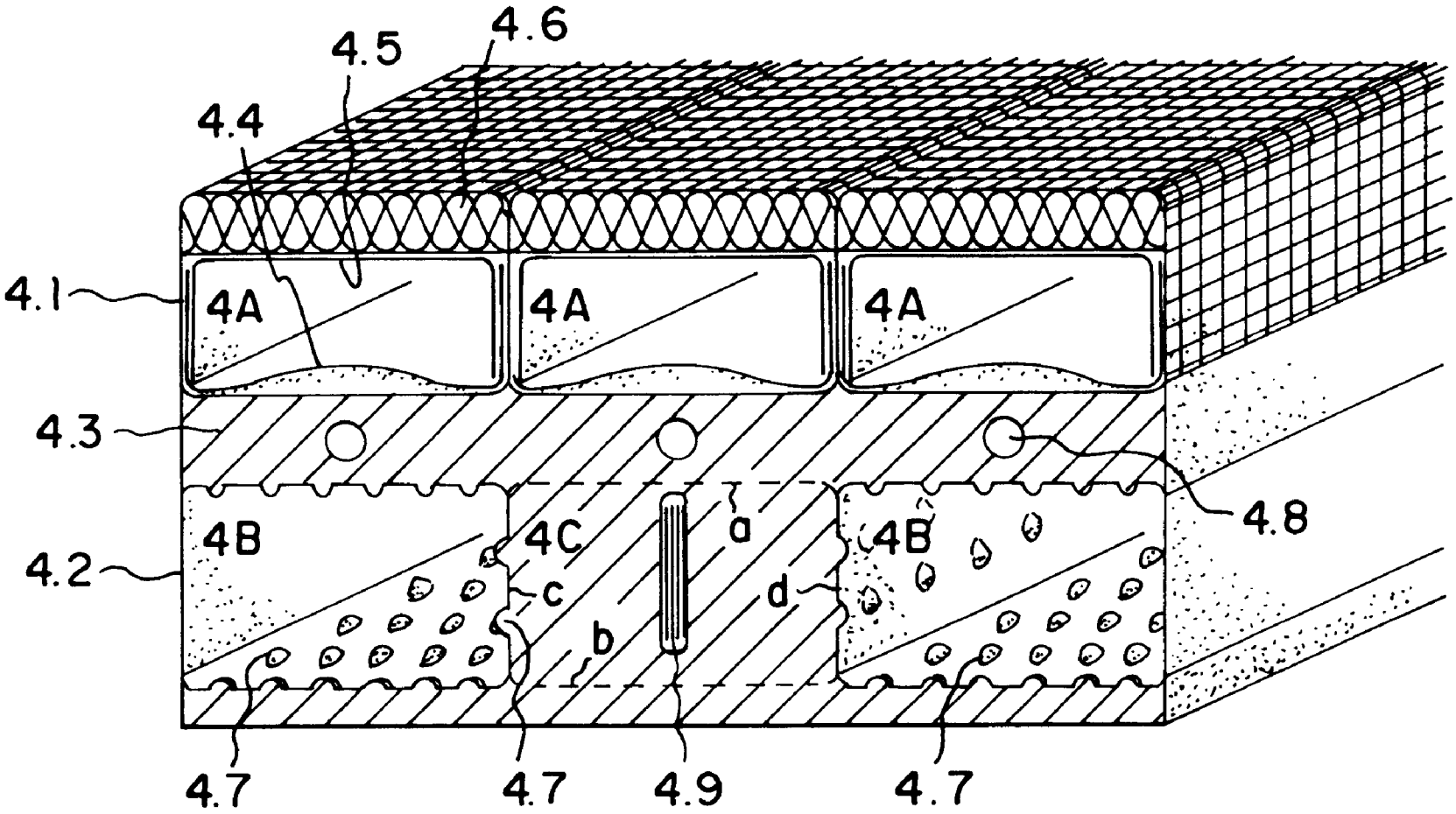

FIG. 4 shows a layered arrangement of sectional elements 4.1 and 4.2 according to the invention, which are joined to each other via an intermediate layer of coating material 4.3. Sectional element 4.1 comprises flow channels 4A, which are each provided with functional layers 4.4 and 4.5 which are comparable with the functional layers 3.4 and 3.5 in flow channel 3A shown in FIG. 3, and which are equipped with an additional functional layer 4.6 which is comparable with functional layer 3.9 in flow channel 3C of FIG. 3. Sectional element 4.2 according to the invention comprises flow channels 4B, which are of a design which is comparable with that of channels 1A in FIG. 1 and in which the coating material 4.7 penetrates in the form of nodules. Flow channel 4C of sectional element 4.2 is completely penetrated by the coating material. The coating material here additionally penetrates flow channels 4B in the form of nodules, via delimiting walls c and d, and thus produces an increase in surface area there. Additional functional elements 4.8 and 4.9 (e.g. heating elements) are embedded in coating material 4.3. In a modified embodiment of the combination of sectional elements and coating material which is illustrated in FIG. 4, the flow channels 4B in sectional element 4.2 can also be joined solely via the delimiting wall a or alternatively can be joined solely via b. In its initial state, sectional element 4.2 would not then have a channel in region 4C, but would have a distance-bridging web joint.

Figure 5:
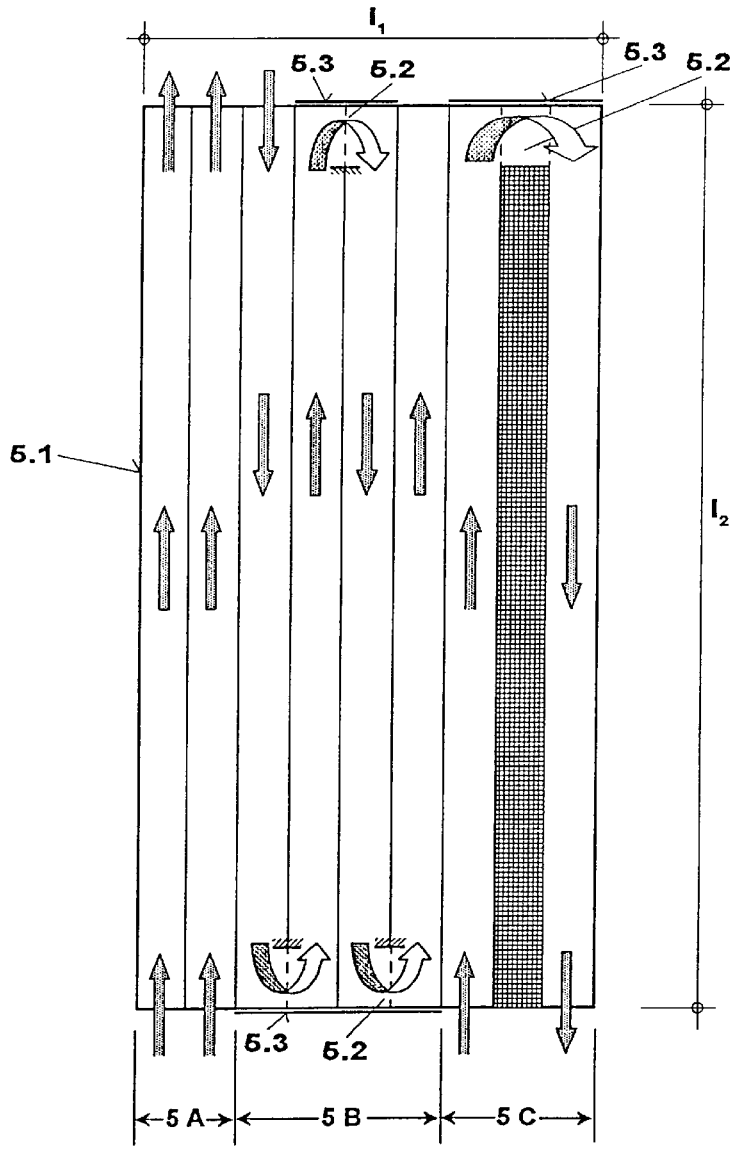

FIG. 5 is a schematic illustration of the flow relationships in a sectional element 5.1 according to the invention of dimensions $l_1 \times l_2$. This element comprises flow zones 5A, 5B and 5C. In flow zone 5A, flow occurs in the same direction in adjacent flow channels. In flow zone 5B, the direction of flow alternates in adjacent flow channels. In flow zone 5C, flow occurs in alternating directions and with a channel being missed. In order to achieve a change of flow, flow zones 5B are provided with overflow regions at 5.2 and with channel occlusion elements at 5.3.

Figure 6:
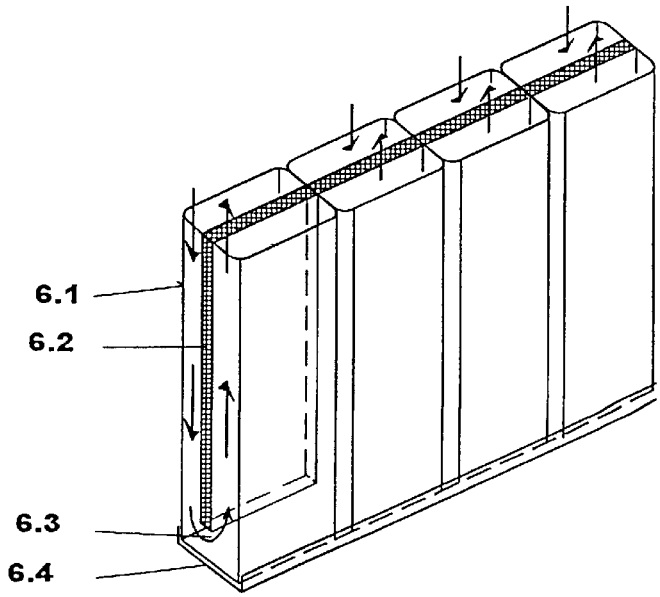

FIG. 6 is a schematic illustration of a sectional element 6.1 which is equipped with a functional layer 6.2, with overflow regions 6.3 and with an occlusion element 6.4 in a manner such that flow occurs in each flow channel of the element in alternating directions and with overflow and underflow.

Figure 7:
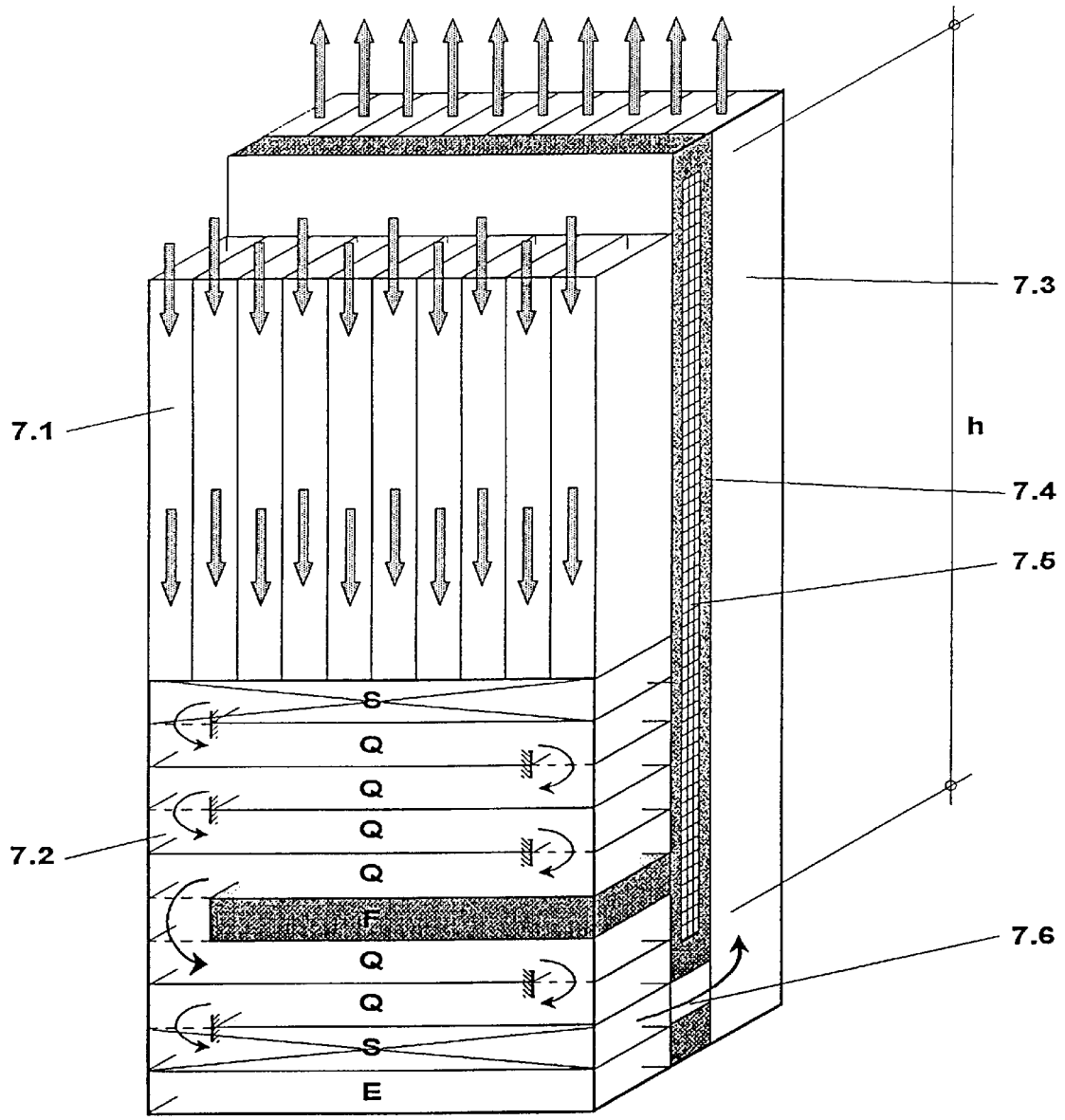

FIG. 7 is a schematic illustration of a layered arrangement of sectional elements 7.1, 7.2 and 7.3 according to the invention, wherein sectional elements 7.1 and 7.2 are disposed in a plane but are displaced by 90° with respect to the alignment of their flow channels. Sectional elements 7.1 and 7.2 are joined to sectional element 7.3 via the coating material 7.4, in which a functional layer 7.5, e.g. a thermal insulation layer, is embedded over a height h. The flow enters via all the channels of the sectional elements 7.1. Sectional element 7.2 has a collecting or distribution channel S at its flow inlet and flow outlet, respectively. Transverse flow, with alternating directions of flow in adjacent channels, occurs in channels Q. Channel E in sectional element 7.2 is and end channel, through which no flow occurs. The flow from the lower collecting channel S enters all the flow channels of sectional element 7.3 at 7.6. The coating material 7.5 here is of open-work form over the entire width of the unit shown. For reasons of clarity of illustration, the requisite channel occlusion elements in sectional elements 7.2 and 7.3 (bottom end) are not shown.

Figure 8:
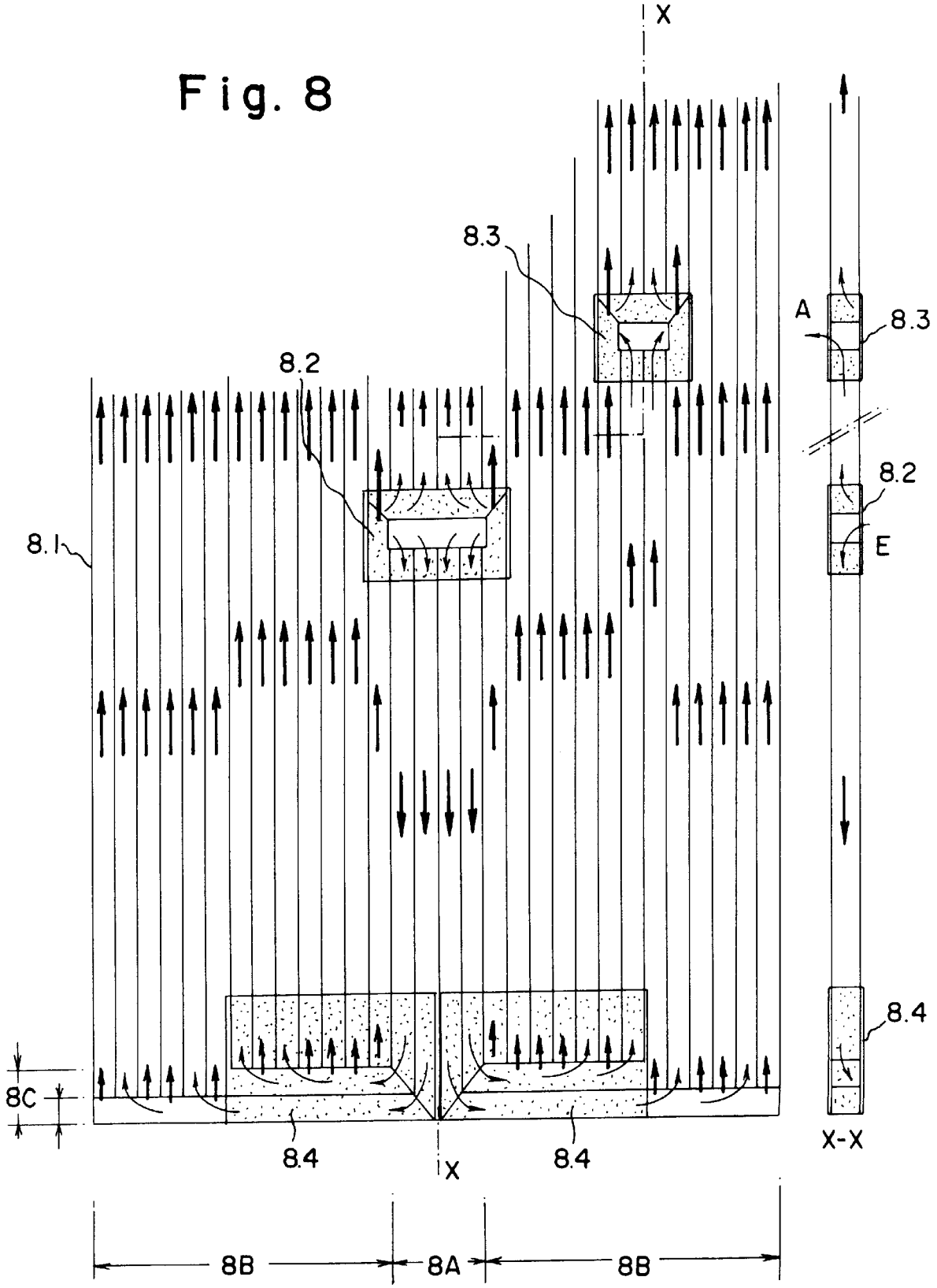

FIG. 8 is a schematic illustration of the flow relationships in a single-layer surface arrangement 8.1 of sectional elements according to the invention. This arrangement comprises a flow inlet region at E and a flow outlet region at A. These two regions each comprise a plurality of flow channels. In region 8A of the arrangement, flow primarily occurs downwards, in regions 8B flow occurs upwards, and in region 8C the flow is aligned horizontally. The flow inlet and outlet regions 8.2 and 8.3, respectively, and the flow deflection regions 8.4, can be inserted as prefabricated sectional modules of the respective standard design, in combination with or without the combination thereof with coating materials, into the surface arrangement of sectional elements according to the invention.

Figure 9:
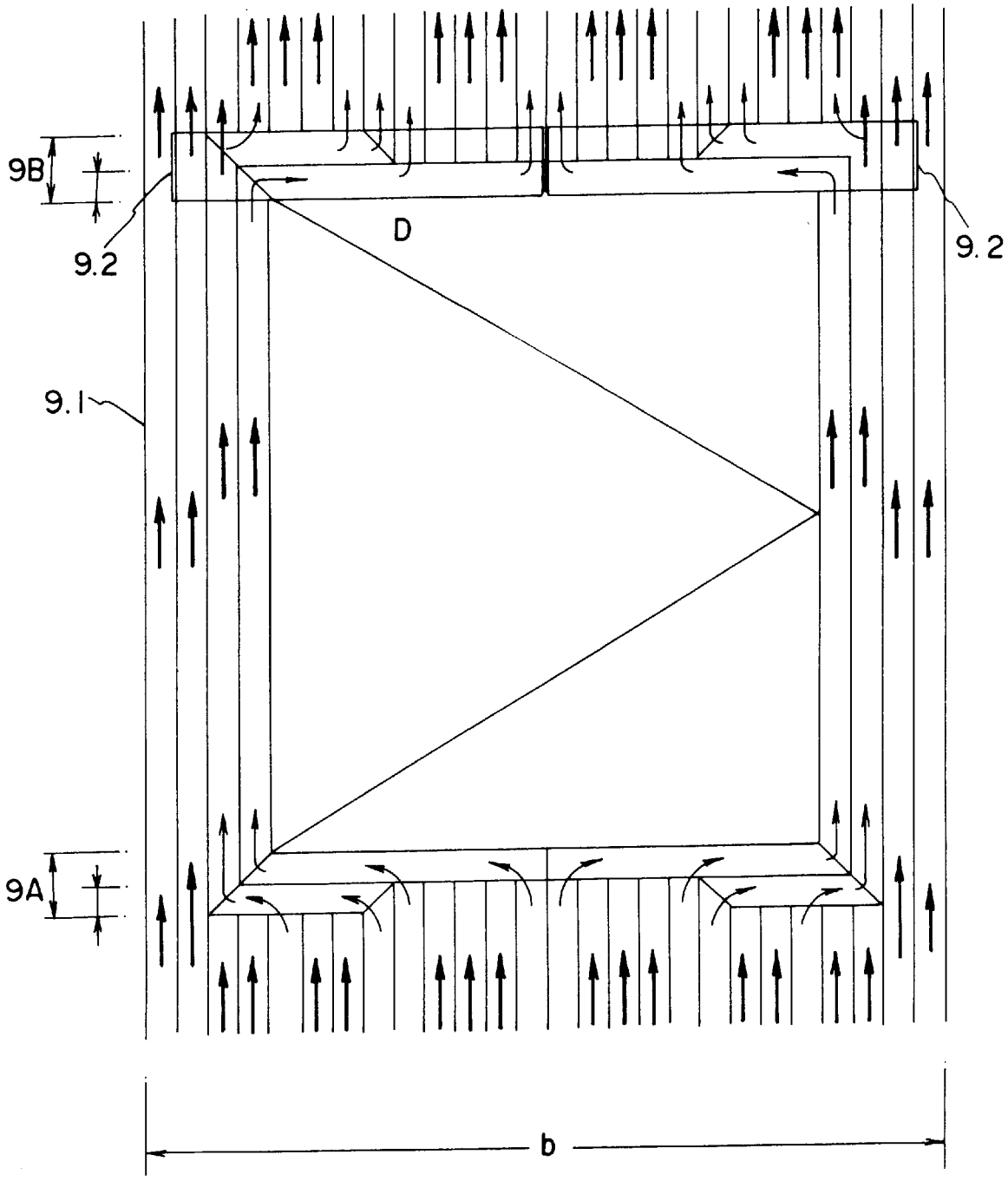

FIG. 9 is a schematic illustration showing how flow can take place round an opening D, e.g. a window, in a surface arrangement of sectional elements 9.1. The flow is primarily oriented upwards over the entire width b of the arrangement. Transverse flow prevails in regions 9A and 9B. In practical use, the flow relationships shown can be achieved by the erection and combination of blanks comprising standard sectional elements (see region 9A). However, the transverse flow regions can also be inserted as prefabricated sectional modules 9.2 (see region 9B) into the surface arrangement, as described in connection with FIG. 8.

Figure 10:
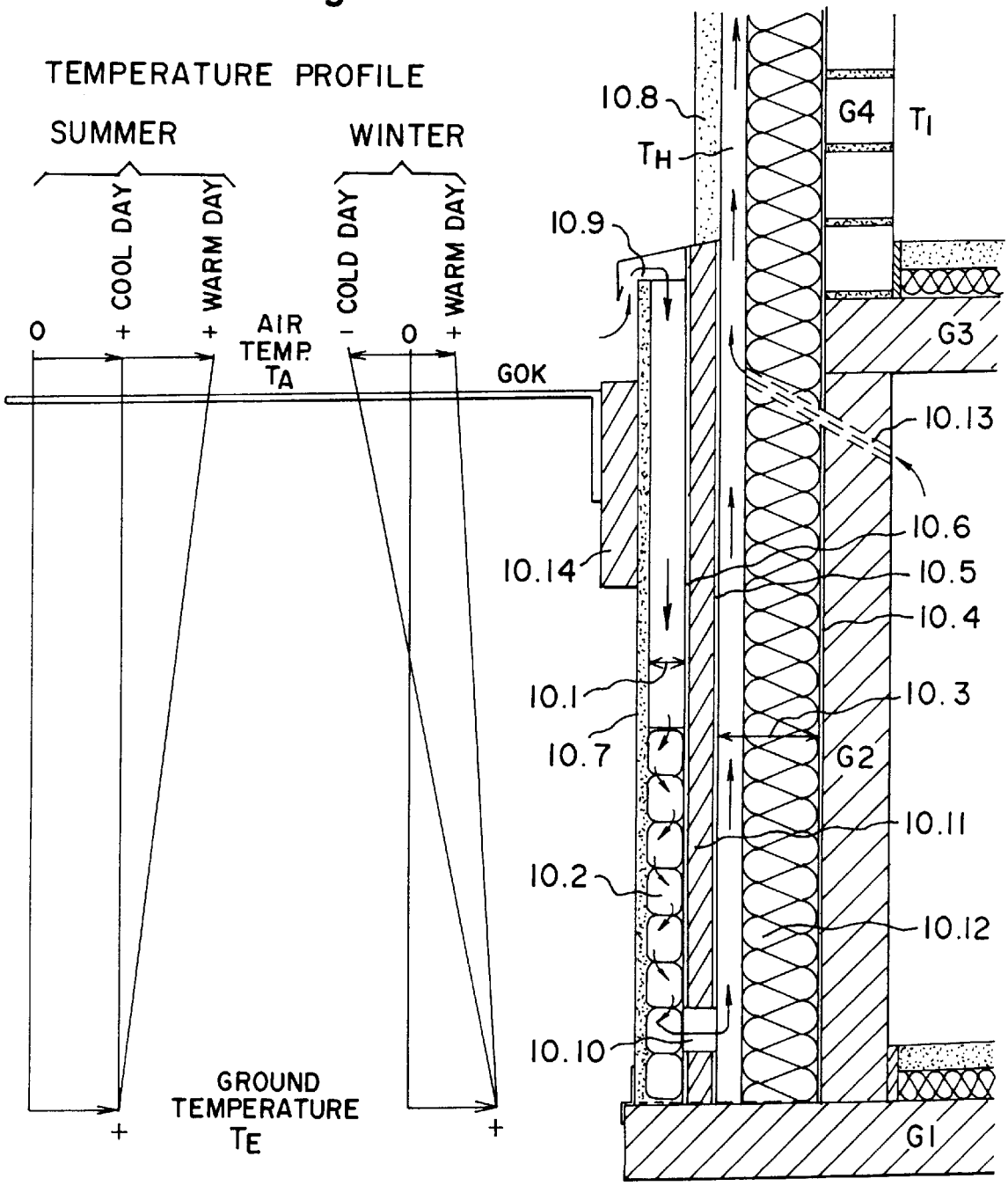

FIG. 10 is a vertical section through an external wall of a building in the region of the basement. G1 denotes the foundation slab, G2 denotes the external wall of the basement, G3 denotes the basement ceiling and G4 denotes the external brickwork of the ground floor. The top edge of the ground is denoted by GOK. The basement wall bears a layered composite comprising sectional elements according to the invention, comparable with that shown in FIG. 7. Starting somewhat above GOK, sectional elements 10.1, 10.2 and 10.3, which are joined via coating materials 10.4, 10.5 and 10.6, are disposed in the region of the basement wall below GOK. The coating material 10.7 is at the same time the protective and sealing layer for the region underground. In a surface combination with other suitable sectional elements, sectional element 10.3 continues in the region above GOK over the entire external wall of the building. The coating material 10.8 forms the weather-protection shell and facade of the building. Ambient air enters sectional element 10.1 at 10.9 as a downwardly directed flow which in sectional element 10.2 becomes a transverse flow with multiple, alternating changes of its direction of flow. The flow enters sectional element 10.3 at 10.10. The functional layers 10.11 and 10.12 are thermal insulation layers and impede the exchange of thermal energy from the upwardly directed harmonisation flow to the downwardly and transversely directed flow and to the internal air in the building, respectively. Under some circumstances, a direct feed connection, e.g. for room ventilation, which is led out of the building to the upwardly directed harmonisation flow, can exist at 10.13. In the region near GOK, the thermal insulation layer 10.14 prevents an unwanted flow of thermal energy between the ground and the downwardly directed flow. A substantially constant temperature $T_E$, which is in the plus range, permanently prevails in the region of the foundation slab G1 about 3 m below GOK. The temperature profiles which are illustrated clearly show the falls in temperature between the external air $T_A$ and the ground temperature $T_E$ in the plane of the foundation slab G1, firstly on cool and warm summer days and secondly on cold and warm winter days. It follows from this that the external air which is fed at 10.9 into the arrangement according to the invention of sectional elements and optionally of sectional modules absorbs thermal energy from the ground in winter and releases thermal energy to the ground on warm summer days. The upwardly directed harmonisation flow in sectional element 10.3, the temperature of which harmonisation flow is thus raised to $T_H$ in winter and is lowered in summer, makes a contribution to the economical air-conditioning of the building due to the reduction of unwanted exchanges of thermal energy between the external air at temperature $T_A$ and the internal building air at temperature $T_I$.

Figure 11:
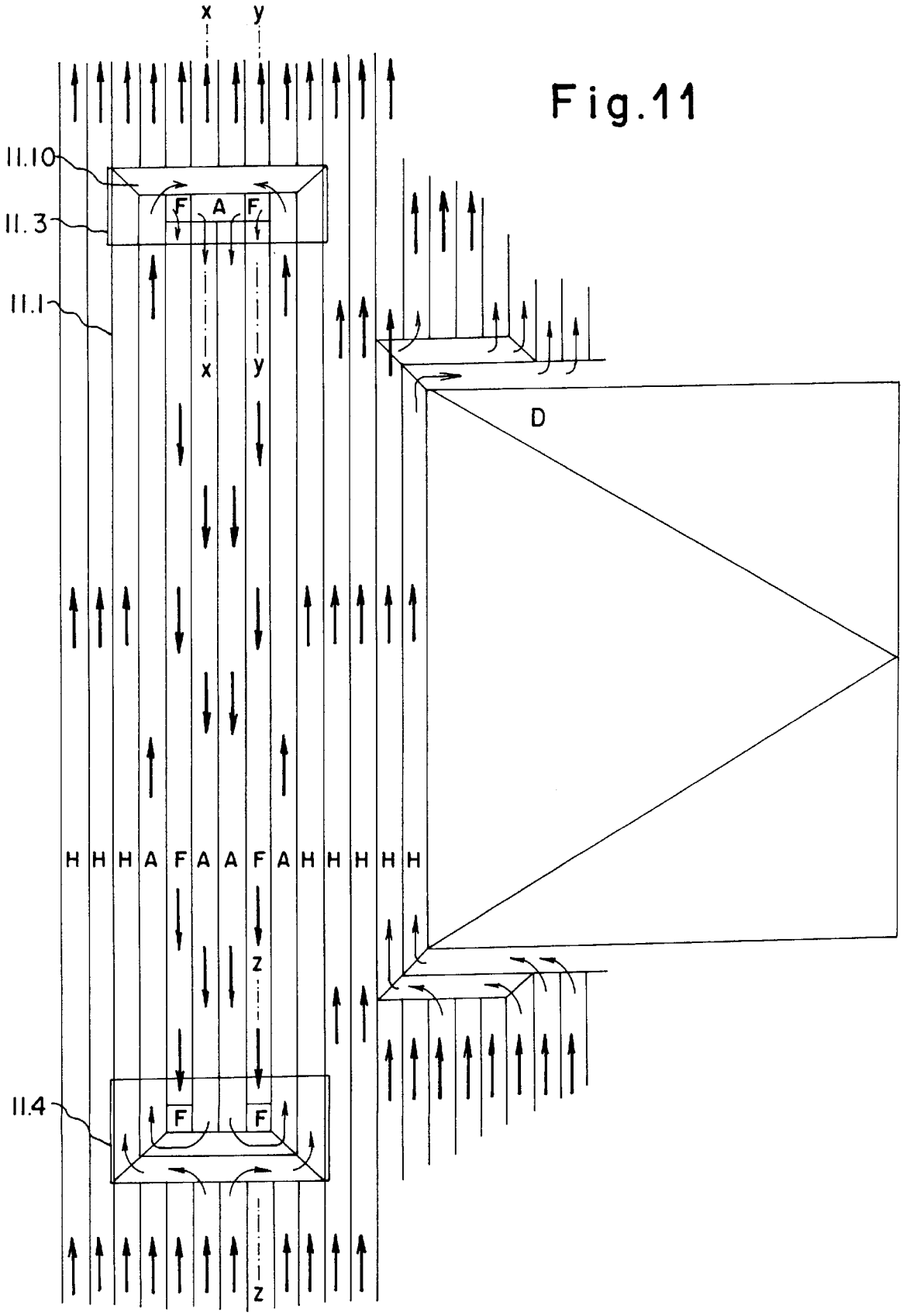
Figure 11A:
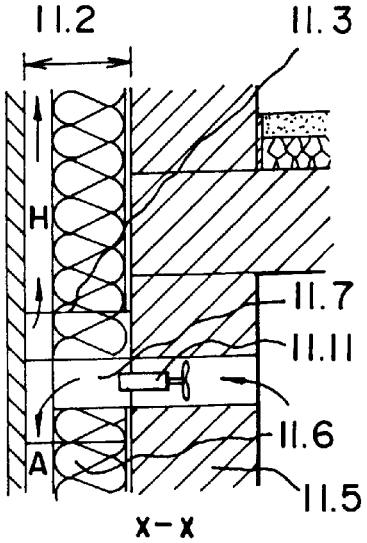
Figure 11B:
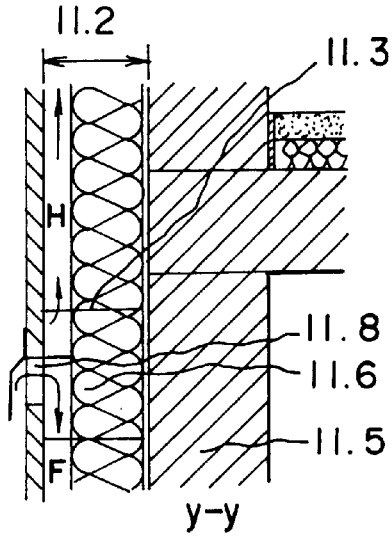
Figure 11C:
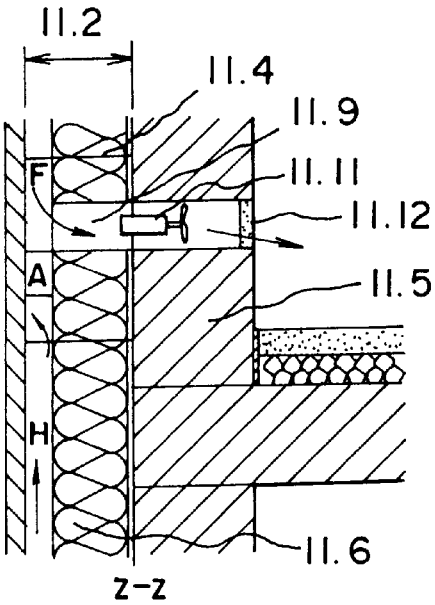

FIG. 11 is a schematic illustration of the flow relationships in a surface composite according to the invention comprising sectional elements and sectional modules according to the invention. The surface composite 11.1 is an integral component of a larger surface composite according to the invention above the top edge of the ground of a building and serves firstly for the utilisation of the thermal energy of outgoing air from the interior of the building in order to pre-heat fresh air/incoming air which is fed into the building, and secondly for the dissipation of residual heat to the harmonisation flow between the external brickwork and the weather-protection shell. Outgoing air enters sectional element 11.2 through the brickwork 11.5 and through the functional layer 11.6 (thermal insulation) at 11.7. Fresh air enters sectional element 11.2 at 11.8. The outgoing air is led through flow channels A with a direction of flow which changes from downwards to upwards, so that an exchange of thermal energy takes place with the downwardly directed flow of fresh air in flow channels F. The fresh air then enters the interior of the building at 11.9, through the functional layer 11.6 and through the brickwork 11.5. The outgoing air enters a collecting channel at 11.10 and is mixed there with the harmonisation flow which flows upwards through flow channels H. In order to promote flow, the outgoing air and incoming air openings 11.7 and 11.9, respectively, can be equipped with auxiliary means, e.g. fans 11.11. In addition, the incoming air opening 11.9 can comprise a filter 11.12 for air purification purposes. The incoming air and outgoing air regions 11.3 and 11.4 of the surface composite according to the invention can be designed as sectional modules as described in connection with FIG. 8. The surface composite

11.1 according to the invention is shown near a window D, for example, in order to make it clear that the outgoing air outlet 11.7 and the incoming air inlet 11.9 lead into the same room. With adaptation of the flow guidance, however, corresponding surface composites can also be employed to cover the ceilings of rooms or partition walls between rooms, in order to provide advantageous air-conditioning of rooms which are separated from each other.

We claim:

1. A flow channel structure comprising a plurality of adjacent flow channels each having at least one channel wall comprising a wall-defining structure and a wall layer, said wall-defining structure having opposing first and second sides and through-holes communicating between said first and second sides, and said wall layer being of extrudable material applied to said first side, each flow channel further having projections of said extrudable material projecting from said second side, the projections being extrusions of said extrudable material through the through-holes from said first side to said second side.

2. A flow channel structure according to claim 1 in the form of a shaped panel.

3. A flow channel structure according to claim 1 in which at least one said channel wall includes a protecting layer to form a multi-layer channel wall.

4. A flow channel structure according to claim 1 in which at least one said channel wall includes an element for supplying, absorbing and/or reflecting heat.

5. A flow channel structure according to claim 1 in which said extrudable material has a consistency which allows, in use, the projections to be eroded and/or melted by a flow medium in the flow channels, and material thus eroded and/or melted from the projections to be transported by the flow medium.

6. A flow channel structure according to claim 1 in which at least one said wall layer separates adjacent said flow channels.

7. A flow channel structure according to claim 1 which is adapted for the flow of a medium in series through sequential said flow channels.

8. A flow channel structure according to claim 1 which is adapted for plural flows of media in parallel through respective said flow channels.

9. A building with at least one room and having an arrangement of flow channel structures according to claim 1, the arrangement being adapted to direct a flow of air from the exterior of the building to below ground level and then to an above ground level external wall of the building, said flow channels effecting heat exchange between the flow of air and the ground, and between the flow of air and the external wall of the building, thereby effecting heat exchange with said at least one room of the building.

10. A building according to claim 9, further having at least one flow driving means for driving the flow of air.

11. A building according to claim 9, further having at least one throttling means for influencing the flow of air.

12. A building according to claim 9 in which the arrangement is adapted to direct a portion of the flow of air into at least one room of the building.

13. A building according to claim 9 in which the arrangement is adapted to gather air from at least one room of the building to join the flow of air at the external wall of the building.

14. A method of forming a flow channel structure according to claim 1, the method including:

providing a mass of the extrudable material at said first side of the wall-defining structure; and extruding a portion of said mass through the through-holes to form the projections at said second side of the wall-defining structure, a non-extruded portion of said mass forming the second wall layer.

* * * * *

UNITED STATES PATENT AND TRADEMARK OFFICE

CERTIFICATE OF CORRECTION

PATENT NO. : 6,269,598 B1
DATED : August 7, 2001
INVENTOR(S) : Wintermantel

It is certified that error appears in the above-identified patent and that said Letters Patent is hereby corrected as shown below:

Title page,
Item "[75]", change: "Erich Wintermantel, Bonn (DE)" to -- Erich Wintermantel, Bonn (DE) and Oswald Landwehr, Meckenheim (DE) --; and
Item "[73]", change: "Wintermantel, Brich (DE)" to -- Wintermantel, Erich (DE) --

Signed and Sealed this

Fourteenth Day of May, 2002

*Attest:*

*Attesting Officer*

JAMES E. ROGAN
*Director of the United States Patent and Trademark Office*